United States Patent [19]

Rohne

[11] Patent Number: 4,729,336

[45] Date of Patent: Mar. 8, 1988

[54] BOAT SEAT BRACKET SECURITY DEVICE

[76] Inventor: Richard E. Rohne, 2115 S. 62nd St., West Allis, Wis. 53219

[21] Appl. No.: 70,308

[22] Filed: Jul. 6, 1987

[51] Int. Cl.[4] ..... B63B 17/00

[52] U.S. Cl. ..... 114/363; 70/232; 297/252

[58] Field of Search ..... 114/363; 70/164, 232, 70/DIG. 57; 297/363, 252, 148, 153, 400, 401, 402, 399

[56] References Cited

U.S. PATENT DOCUMENTS

| | | | |
|---|---|---|---|
| 1,881,620 | 10/1932 | Jandus et al. | 70/232 |
| 2,171,664 | 9/1939 | McFarland | 70/232 |
| 2,500,375 | 3/1950 | Parker | 70/232 |
| 3,753,359 | 8/1973 | Frey | 70/232 |
| 4,030,324 | 6/1977 | Rizio | 70/232 |
| 4,294,088 | 10/1981 | Barr | 70/232 |
| 4,658,607 | 4/1987 | Muse | 70/232 |

*Primary Examiner*—Joseph F. Peters, Jr.
*Assistant Examiner*—Thomas J. Brahan
*Attorney, Agent, or Firm*—Fuller, Puerner & Hohenfeldt

[57] ABSTRACT

A device for locking a boat seat bracket to a seat support beam in a boat. A conventional bracket has a base and a pair of long U-shaped clamping members formed of parallel rods threaded on their ends and slidable in opposite directions through the base. In the new device, nuts on the parallel rods of one member are prevented from turning by nut capturing means on a first lock bar that fits over the rods before the nuts are installed. A clamp bar is fitted over the parallel rods on the other clamping member and it has the bolt of a lock projecting from it. A second lock bar with nut capturing means is slid onto the last named rods and also over the lock bolt. The body of a key operated lock is slid onto the lock bolt to hold the second lock bar in place.

5 Claims, 9 Drawing Figures

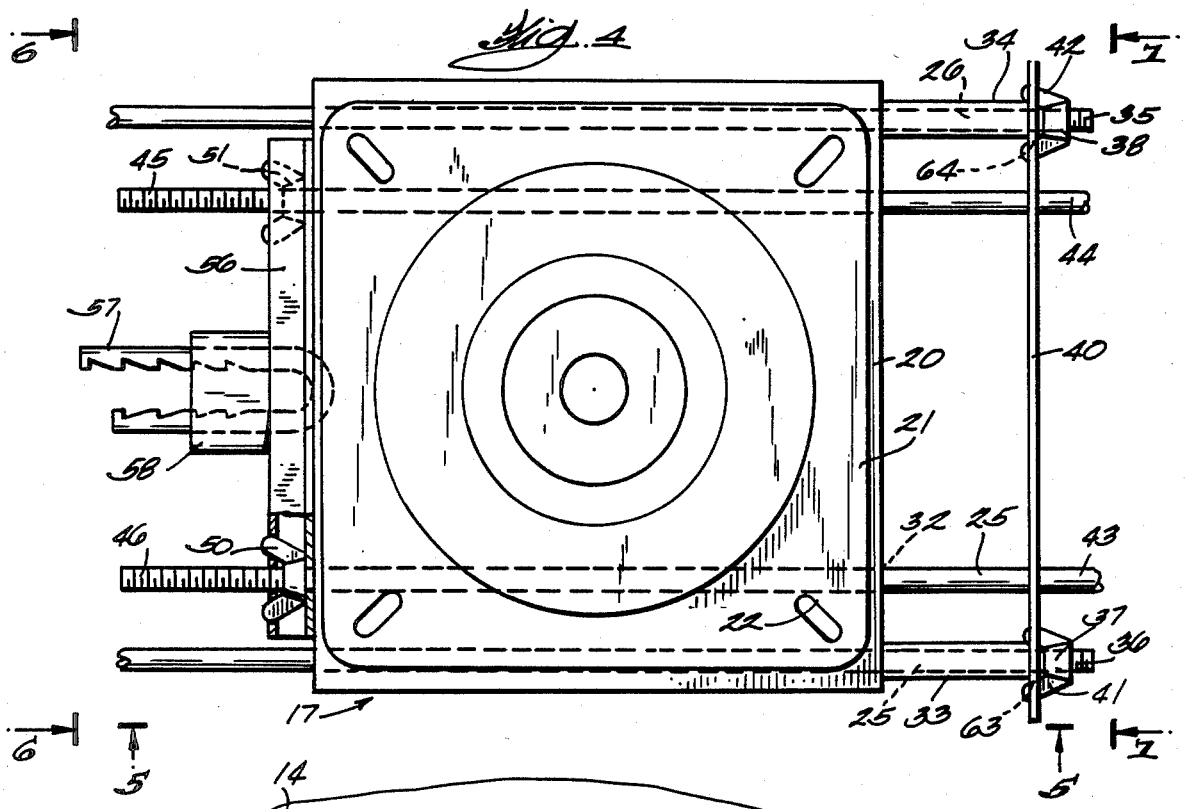
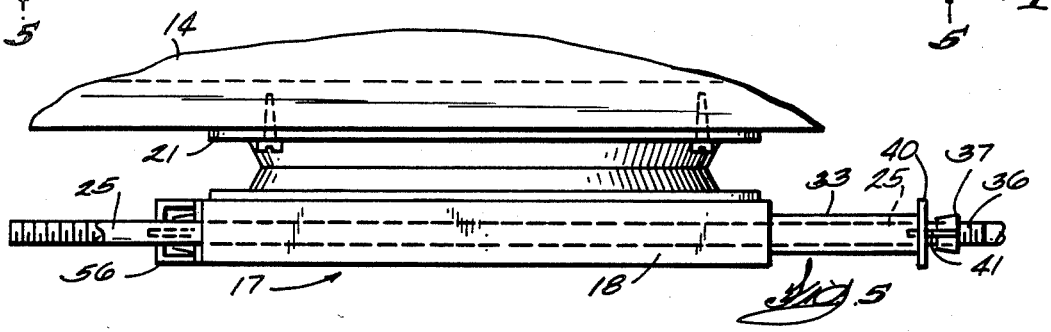
Fig. 5
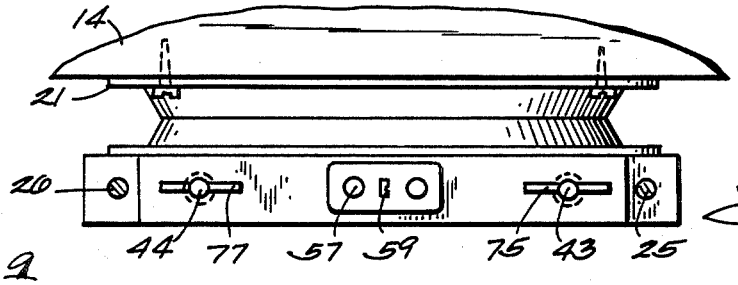
Fig. 6
Fig. 9
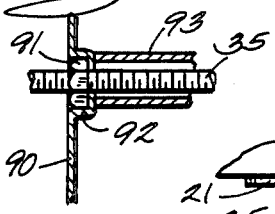
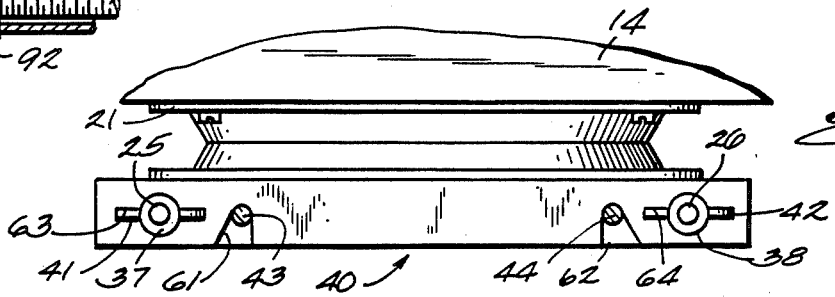
Fig. 7

BOAT SEAT BRACKET SECURITY DEVICE

BACKGROUND OF THE INVENTION

The invention disclosed herein is a device that is retrofitted to a boat seat bracket for prohibiting unauthorized removal of a boat seat from the seat mounting beam on a boat.

In most boats, there is a seat mounting beam spanning from side to side of the boat. The seat itself is usually mounted on a commercially available swivel bracket which is adapted for clamping it to the seat mounting beam. Seat mounting brackets usually comprise two generally U-shaped rods on whose legs there are long threads. The U-shaped members slide toward and away from each other through holes in a box-like metal base so they can be pushed up against the sides of the seat mounting beam and then clamped by turning wing nuts on the threaded rods. The seat and the bracket on which it is mounted are removed from the mounting beam by loosening the wing nuts sufficiently to slide the frictionally gripped legs of the U-shaped rods off the sides of the mounting beam. Sometimes seats are removed without authorization by the owner. A thief only has to loosen a pair of wing nuts to allow removing the seat from the boat.

SUMMARY OF THE INVENTION

The invention constitutes an accessory kit which can be installed on a conventional boat seat mounting bracket to enable the wing nuts of the bracket to be locked against rotation so the bracket cannot be loosened nor removed from the seat mounting beam.

Briefly stated, in accordance with the invention, lock bars are fitting over the corresponding threaded ends of each of the U-shaped rods constituting the clamping members of the seat mounting bracket. The clamping members are adjusted to clamping position against opposite sides of the seat mounting beam such that the wing nuts on the respective ends of the U-shaped rods of one of the clamping members register in slots in one of the lock bars, thereby prohibiting further rotation of the one pair of wing nuts. The pair of wing nuts on the other threaded rod clamping members are turned tightly against the lock bar on the other side of the mounting beam from the first one. When the seat mounting bracket is gripping the sides of the seat mounting beam firmly enough to prevent withdrawal by a person of anything but unusual strength, another lock bar is slid over the threaded rods. The lock bar has holes that allow it to slide over the threaded rods and each of the holes has slots radiating from it which slide over the wings of the wing nuts, thereby prohibiting their rotation for loosening the lock bar. A clamp bar has the bolt of a lock fastened to it. The clamp bar has holes in it for allowing it to slide onto the threads of the clamping member rods. The lock bar has holes which allow it to slide over the lock bolt. The lock body is then pushed onto the lock bolt and locked. Thus, to remove the seat bracket from the mounting beam, it is necessary to have a key to unlock the lock so the lock bar can be slid off the bolt to thereby remove the restraint against rotation of the wing nuts.

A more detailed description of an illustrated embodiment of the new boat seat bracket security device will now be set forth in reference to the accompanying drawings.

DESCRIPTION OF THE DRAWINGS

FIG. 4 is a plan view of the assembly depicted in FIG. 2;

FIG. 5 is a fragmentary side elevational view taken on a line corresponding with 5—5 in FIG. 4;

FIG. 6 is an end elevational view of the assembly taken on a line corresponding with 6—6 in FIG. 4;

FIG. 7 is an end elevational view of the assembly with the security device attached taken on a line corresponding with 7—7 in FIG. 4;

FIG. 9 illustrates an alternative form of lock bar for preventing nuts from being turned off a threaded rod.

DESCRIPTION OF A PREFERRED EMBODIMENT

Figure 1:
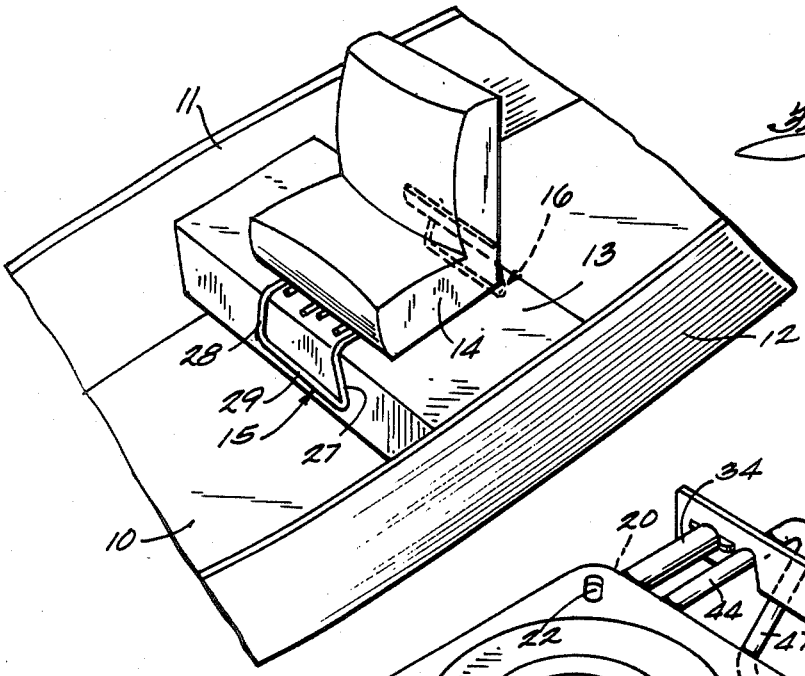
FIG. 1 is a perspective view of a fragment of a boat hull showing the seat mounting cross beam extending from side to side of the boat and showing the legs of the mounting bracket assembly clamped to the beam for securing the seat.

FIG. 1 shows a fragment of a boat having a bottom 10 and sides 11 and 12. A beam 13 is fastened at its opposite ends to the sides of the boat. This beam is usually a shell filled with closed cell foam for adding to the buoyancy of the boat as is required if the boat should tip over or be filled with water. A seat 14 is supported above beam 13. The seat is mounted to a swivel bracket, not visible in FIG. 1. The swivel bracket includes a pair of U-shaped clamping members which are generally designated by the numerals 15 and 16 in FIG. 1.

Figure 2:
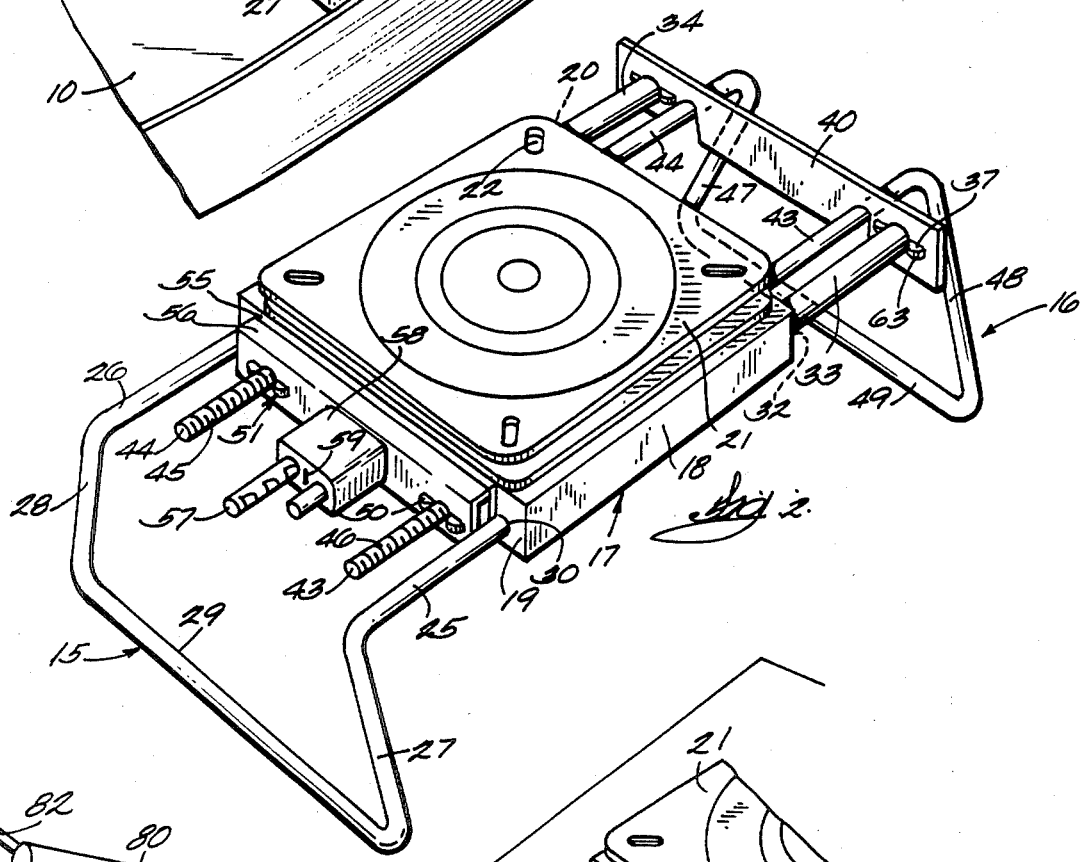
FIG. 2 is a perspective view of a conventional clamp on boat seat swivel mounting bracket on which the new security device kit has been installed.

A conventional swivel boat seat mounting bracket is depicted in FIG. 2 with the seat itself removed but with the new security device installed. The conventional swivel bracket comprises a base 17 which can be similar to a metal box having sidewalls such as the one marked 18 and end walls 19 and 20. Base 17 has a seat mounting plate 21 mounted on it. Plate 21 is rotatable about a vertical axis. It is provided with holes 22 that facilitate fastening the seat 14 to it.

Members 15 and 16 for clamping the swivel bracket to beam 13 in the boat are similar. Typical member 15 is comprised of a generally U-shaped rod including parallel rod portions 25 and 26 which terminate in vertical leg portions 27 and 28 that are joined together by a cross tie portion 29. Rods 25 and 26 extend through aligned holes such as the one marked 30 in FIG. 2 in end wall 19 of the base and another hole 32 in the opposite end wall 20 of the base. Substantial lengths at the ends of the parallel rods 25 and 26 of typical clamping member 15 are threaded. In FIG. 2, the threads are presently concealed by reason of the fact that the rods extend through spacer tubes 33 and 34. The threads 35 on rod 26 and the threads 36 on rod 25 are visible in FIG. 4. There are wing nuts 37 and 38 on the threaded ends of rods 25 and 26, respectively. In accordance with the invention, the new security device kit includes a lock bar 40. In the conventional swivel bracket configuration, lock bar 40 is, of course, not present. One may see also in FIGS. 2 and 4, particularly well, that for the purposes of the invention the wing nuts 37 and 38 are turned onto rods 25 and 26, respectively, backwards. That is, the wings 41 and 42 of the wing nuts lead the body of the nuts on the threads. In the conventional or existing swivel bracket structure, with lock bar 40 not being present, the wing nuts would be turned on the threaded rods in normal fashion and tightened in which case, as should be evident in FIG. 2, the left U-shaped portion of the clamping member including legs 27 and 28 would be pulled tightly up against the side of the seat beam 13 in the boat. The construction and function of lock bar 40 will be discussed in greater detail later.

In the conventional swivel bracket assembly, there is another clamping member 16 which is comparable to clamping member 15. Clamping member 16 includes parallel rod portions 43 and 44 having threaded end portions 45 and 46. Parallel rod portions 43 and 44 are continuous with leg portions 47 and 48 joined together by a cross tie portion 49. There are wing nuts 50 and 51 turned onto the threaded end portions 45 and 46 of rods 43 and 44. In the existing conventional swivel bracket, wing nuts 50 and 51 would be turned on in the normal fashion until they butted up against the end face 19 of the base 17, thus causing the cross tie rod 49 to pull tightly against the side of the seat beam 13 in the boat. Tightening of four wing nuts in the conventional bracket causes the bracket to be clamped tightly onto the seat beam 13.

FIGS. 2–7 illustrate additional parts of the new security device kit. FIG. 2 shows that a clamp bar 55 interfaces with end wall 19 of bracket base 17. Another part of the kit is a lock bar 56 which is shown in FIG. 2 in its operative position. Clamp bar 55 has a U-shaped bolt 57 of a key operated lock fastened to it. The two legs of the U-shaped bolt pass through a lock body 58 and the body is engaged with the bolt by turning a key, not shown, in a key slot 59 in the lock body.

The details of the lock bar 40 mentioned earlier in connection with FIG. 2 will now be described in more detail in reference to FIGS. 2, 3, 4 and 7. FIG. 7 shows that the lock bar 40 has two notches 61 and 62. These notches register on rods 43 and 44 which are parallel and part of clamping member 15. The wing nuts 37 and 38 are screwed onto the free threaded ends of rods 25 and 26 and their wings 41 and 42 are installed backwards so they will register in corresponding by shaped radially extending slots 63 and 64 and they will be captured in the slots. FIG. 4 reveals how the wings 41 and 42 of the wing nuts extend through slots 63 and 64 to lock the wing nuts against turning. To install lock bar 40 of the kit, the wing nuts 37 and 38 which are put on the threaded rods 25 and 26 in normal fashion by the swivel bracket manufacturer are turned off of the rods. Lock bar 40, being provided with holes centrally of the slots, is slid over rods 25 and 26 and the notches 61 and 62 allow the lock bar to drop over the opposite pair of rod members 43 and 44. In adapting the kit to the conventional swivel bracket, the wing nuts are then turned on backwards, that is with their wings leading as shown in FIG. 4 particularly well. Before the wing nuts 50 and 51 are anywhere near tight and before lock body 58 is in place, the rod portions 25 and 26 can be pulled to the right as viewed in FIG. 4 to provide space between the ends of the spacer tubes 33 and 34 and the wall 20 of base 17. With the spacers 33 and 34 and lock bar 40 pushed away from the wing nuts, the wing nuts can be turned onto threads 35 and 36 for some distance. Then the rods 25 and 26 are pulled to the left in FIG. 4 or, alternatively, base 17 is pushed to the right to compress the spacers 33 and 34 against lock bar 40 which then pulls the wings 41 and 42 of the lock nuts into the slots so these lock nuts can no longer turn. FIG. 5 shows a profile of how the wings 41 register in the slots of lock bar 40.

Figure 3:
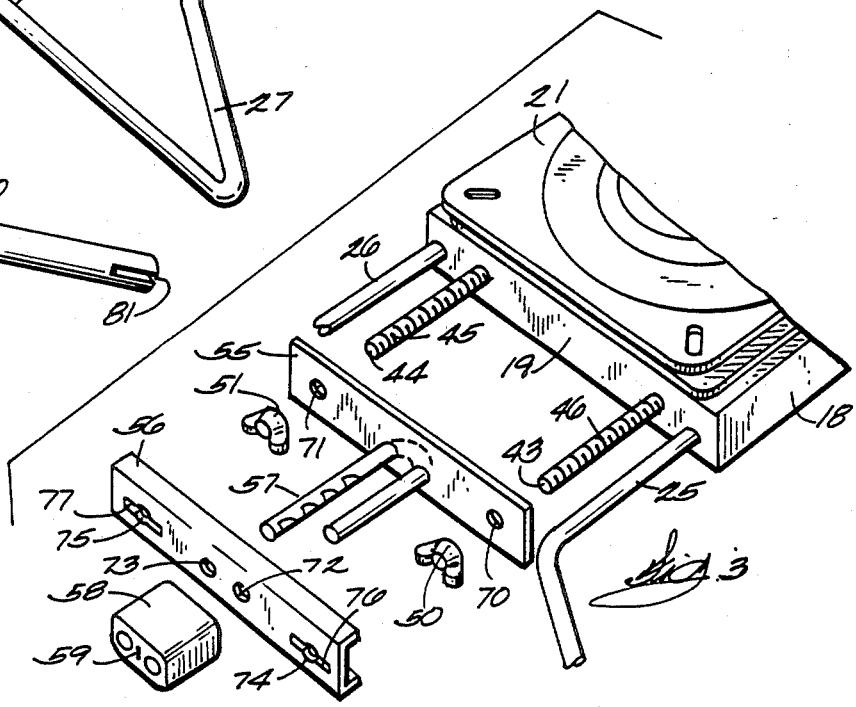
FIG. 3 is an exploded perspective view of the mounting bracket base associated with a clamp bar on which there is a lock bolt and a lock body and a lock bar which cooperates with the clamp bar and lock bolt to prohibit turning of clamping wing nuts.

The parts of the kit that bring about locking of the swivel bracket assembly onto the seat beam 13 of the boat are shown especially clearly in the FIG. 3 exploded view. The conventional seat bracket as received from the manufacturer has the wing nuts 50 and 51 turned onto threads 45 and 46 of parallel rod portions 43 and 44. However, to install the locking members of the new kit, wing nuts 50 and 51 are turned off of the rods and clamp bar 55 is pushed onto the rods 43 and 44. For this to happen, clamp bar 55 is provided with a pair of laterally spaced apart holes 70 and 71. After the clamp bar is placed on the threaded rods, the wing nuts 50 and 51 can be turned on to cause the threaded rod portions 43 and 44 to pull out of the base 18 at which time clamping pressure is developed at the opposite ends of the rods due to the leg portions 47 and 48 of the locking member 16 developing pressure against the side of the seat beam 13. Since the other wing nuts 37 and 38 may be tightened already, tightening of wing nuts 50 and 51 on rods 43 and 44 clamps the swivel seat bracket tightly to the seat supporting beam 13 of the boat. Now, to assure that the wing nuts 50 and 51 cannot be turned off to release the seat bracket assembly, the lock bar 56 is pushed onto the legs of the U-shaped lock bolt 57. There are two holes 72 and 73 in lock bar 56 to permit pushing the clamp bar onto lock bolt 57. The lock bar 56 also has holes 74 and 75 to permit it to be pushed onto parallel rods 43 and 44. Holes 74 and 75 have slots 76 and 77 extending outwardly from them. The slots are sized to accommodate the wings of wing nuts 50 and 51. So during the installation, the wing nuts 50 and 51 are rotated to align their wings with slots 76 and 77 in which case the wings will register in the slots and the wing nuts will be prohibited from turning. Now, to prevent the lock bar 56 from being backed off, which would allow access to the wing nuts so they could be turned loose, the key lock body 58 is pushed onto the U-shaped lock bolt 57 so lock bar 56 cannot be backed away from the wing nuts sufficiently for them to leave the slots and become turnable. Note that the lock bar 56 is a channel-like member so that the bodies of the wing nuts will nest in the lock bar.

A plan view of the swivel bracket with the parts of the kit constituting the new security device installed is depicted in FIG. 4. The four wing nuts, 50, 51 and 37, 38 are tightened and the bracket is clamped to the seat beam in the boat. Wing nuts 37 and 38 cannot be turned because their wings are registered in the slots of lock bar 40. Wing nuts 50 and 51 cannot be turned because their wings are registered in the slots in lock bar 56. The lock bar cannot be slid back because it is restrained by the body 58 of the lock interfacing with the lock bar.

Figure 8:
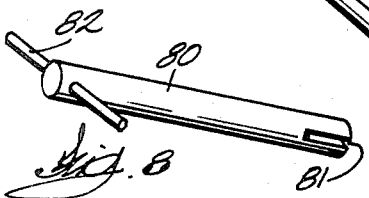
FIG. 8 shows a tool which can be used to tighten the wing nuts on the seat mounting bracket optionally to tightening the nuts with fingers.

FIG. 8 shows a tool for tightening the wing nuts tighter than could be obtained by turning them with one's fingers. This tool, in the nature of a wrench, is optional. It comprises a tubular shaft 80 having a diametral end slot 81 and a handle 82. The width of the end slot is sufficient for it to slide over the wings of the wing nuts so that, using the handle 82 to turn the shaft, the wing nuts can be turned on or off the threaded rods of the clamping members 15 and 16.

In the preferred embodiment described above, wing nuts are used for clamping since they are on the conventional seat bracket when purchased. Other types of nuts, such as hexagon nuts or elliptically shaped nuts, not shown, could be used for example. In such case, instead of having slotted holes in the lock bars for capturing wing nuts, the holes in the lock bars would have a non-circular shape that is complementary to the shape of the chosen nuts so the nuts would register in the holes and the holes would capture the nuts against turning. If hexagon nuts are used, holes with parallel opposite edges would be punched in the lock bars. In this case a standard wrench used for gripping hexagon nuts could be used to tighten the clamping members.

FIG. 9 shows a lock bar 90 for preventing a nut from being turned off the thread 35 when hexagon nuts 91 are used in place of wing nuts. The bar 90 has a depression 92 which surrounds the nut closely so a wrench cannot be fitted on the nut. The back of the depression bears on a spacer tube 93.

Although an embodiment of the invention has been described in detail, such description is intended to be illustrative rather than limiting, for the invention may be variously embodied and is to be limited only by interpretation of the claims which follow.

I claim:

1. A device for locking a boat seat bracket to a seat support in a boat, the bracket comprising a base having opposite sides, two clamping members each comprised of a part for gripping the seat support and a pair of parallel rods extending, respectively, in opposite directions from said parts slidably through said base, the end portions of said rods having threads where they project through said base, said device comprising:

a first lock bar means having nut capturing holes for sliding over the threads on the pair of rods projecting from one side of said base, nuts for being turned onto the threads of said rods so when said lock bar means is forced toward said nuts by developing a clamping force with said members, said nuts register in and are prevented from turning by said nut capturing holes, clamp bar means having holes for sliding over the threads of the other pair of rods projecting from the other side of said base and a bolt for a lock fixed on and extending from said clamp bar means, nuts for being turned onto said other pair of rods to secure said clamp bar means on said rods and to develop a clamping force by said clamping members, and a second lock bar means having nut capturing holes for sliding over said other threaded rods, said second lock bar means being slidable onto said rods sufficiently for said nuts to register in and be prevented from turning by said nut capturing holes, the second lock bar means having holes for sliding over said lock bolt such that by engaging the body of a lock to said lock bolt the lock bar means is locked in place.

2. A device for locking a boat seat bracket to a seat support in a boat, the bracket comprising a base having opposite sides, two clamping members each comprised of a part for gripping the seat support and a pair of parallel rods extending, respectively, in opposite directions from said parts slidably through said base, the end portions of each pair of rods having threads where they project through said base, said device comprising:

a first lock bar means having spaced apart slotted holes for sliding over the threads on the pair of rods projecting from one side of said base, wing nuts for being turned onto the threads of said rods with the wings of said nuts leading so when said first lock bar means is forced in a direction to cause said slots to pass onto the wing nuts turning of said nuts is prevented, clamp bar means having holes for sliding over the threads of the other pair of rods projecting from the other side of said base and a bolt for a lock fixed on and extending from said clamp bar means, wing nuts for being turned onto said other pair of rods with the wings of said nuts trailing for securing said clamp bar means, a second lock bar means having slotted holes for sliding over said other threaded rods sufficiently far for the wings of said wing nuts to enter the slotted holes to prevent said nuts from being turned and said second lock bar means having holes for sliding over said lock bolt such that by engaging the body of a lock to the lock bolt the lock bar means is locked in place.

3. The device according to claim 2 wherein:

said second lock bar means is a channel-shaped member having a face surface and parallel legs for pressing against said clamp bar means and for spacing said face surface from said lock bar means so the bodies of said wing nuts do not interfere with the wings extending into the slots.

4. The device according to claim 2 wherein said first lock bar means has spaced apart notches for fitting onto the pair of rods other than the pair which has the nuts with the leading wings on them.

5. The device according to claim 2 wherein said lock bolt is a U-shaped element having two parallel legs and a curved portion joined with said legs, said clamp bar having holes for said legs to extend from one side of said clamp bar with said curved portion on the other side, and lock means for securing said bolt to the second lock bar.

* * * * *